US005201193A

United States Patent [19]

Sundhar et al.

[11] Patent Number: 5,201,193

[45] Date of Patent: Apr. 13, 1993

[54] COOLING DEVICE FOR BEVERAGES

[76] Inventors: Shaam P. Sundhar, 87 Juniper Ave., Westerville, Ohio 43081; Biharilal B. Lund, 43 Lavender Dr., Edison, N.J. 08820

[21] Appl. No.: 837,145

[22] Filed: Feb. 19, 1992

[51] Int. Cl.[5] ..... F25D 3/00

[52] U.S. Cl. ..... 62/293; 62/294; 62/457.4; 222/5; 222/91

[58] Field of Search ..... 62/294, 457.1, 457.9, 62/293; 222/5, 565, 91

[56] References Cited

U.S. PATENT DOCUMENTS 2,536,001 12/1950 Chase ..... 62/294
2,699,883 1/1955 Meyers ..... 222/5
3,077,085 2/1963 Johnston ..... 62/294

*Primary Examiner*—John M. Sollecito
*Attorney, Agent, or Firm*—Biebel & French

[57] ABSTRACT

A beverage cooling device is provided for use with a capsule containing preferably liquified gas such as carbon dioxide. The beverage cooling device includes a cap section having a top with at least one aperture formed therethrough, a push rod projecting downwardly from the top, a sidewall, and a base. Additionally, the beverage cooling device includes a base section detachably secured to the cap section with the base section having a bottom and a base section top. The base section top has formed therein a base section aperture and the base section has projecting upwardly therefrom a pierce pin. The base section bottom also has a lower surface adjacent the pierce pin.

10 Claims, 3 Drawing Sheets

COOLING DEVICE FOR BEVERAGES

BACKGROUND OF THE INVENTION

The present invention relates generally to a beverage cooling device, and more particularly, to such a device as may be submerged into a beverage.

It has been estimated that more than one billion beverage cans are sold or consumed every single day. During consumption of most beverages from a can or bottle, the desirable temperature of consumption is preferably about 45° F. In order to achieve this temperature, grocery stores and other convenience stores, as well as individual members of the consuming public and restaurants, of necessity keep the beverage cans refrigerated until the beverage contained therein is consumed.

Refrigeration of the beverage containers not only costs money from the standpoint of the energy consumed by the refrigeration of the beverages, but also consumes storage space which perhaps could have been more effectively utilized for the storage of other products. Additionally, since refrigeration units also typically utilize freon gas, which gas has been linked to depletion of the ozone, there are several reasons why it would be desirable to not have to refrigerate beverage containers.

Unfortunately, it has not yet been acceptable practice to serve canned beverages which have not been refrigerated, except to the extent that ice is provided with the beverage to be consumed to lower the temperature of the beverage to about 45° F. before consumption. However, the use of ice in the lowering of the temperature of a beverage has the unwanted effect of watering down the beverage to be consumed, and thus adversely affecting the taste.

On a much larger scale, large beverage containers such as beer kegs, and to a lesser extent cans and bottles, have been cooled by submerging them in ice. Sometimes, fire extinguishers have been used to cool the container wall itself such that over a period of time the cooled container walls in turn reduce the temperature of the beverage contained therein.

Other attempts have been made to cool items through the use of chemical reactions. For example, U.S. Pat. No. 3,874,504 discloses a chemical thermal pack which has a sealed envelope filled with a powder that produces or absorbs heat when the powder is dissolved in water. The envelope is separated from a quantity of water by a rupturable membrane. The envelope is contained within an outer pouch. Additional examples of heat producing thermal packs are disclosed in U.S. Pat. No. 3,328,136 and U.S. Pat. No. 2,979,463.

One drawback associated with normal usage of each of these thermal packs is that, at best, they could only be utilized to cool the outside of the beverage container and, as such, a large amount of their cooling effectiveness is lost, since only one side of such a pack could be in contact with the beverage container. Additionally, attempts to cool a can in this manner result in the temperature difference from abient being approximately 10° F., which is not sufficient. Further, such packs are relatively bulky.

It is thus apparent that the need exists for an improved beverage cooling device which can effectively cool a beverage prior to consumption.

SUMMARY OF THE INVENTION

The problems associated with the prior beverage cooling devices and arrangements are overcome in accordance with the present invention by forming a relatively cylindrically shaped beverage cooling device having a cap section and a base section. The cap section comprises a top having at least one aperture formed therethrough. Additionally, the cap section comprises a push rod which projects downwardly from the top. The base section is preferably detachably secured to the cap section. The base section has a bottom, as well as a base section top. The base section top has formed therein a base section aperture. The base section bottom has a pierce pin projecting upwardly therefrom.

Preferably the top comprises a plurality of apertures. Additionally, the cap section comprises a sidewall as well as a base, with the push rod extending beyond the base. Additionally, preferably the cap section and the base section both have screw threads for securing of the two sections together.

In the preferred embodiment of the invention, the push rod comprises a rod sidewall and a rod base, with the rod base including a rod indentation. Adjacent to the pierce pin is a lower surface. More preferably between the pierce pin and the lower surface is a recessed surface.

There is also disclosed by this invention a beverage cooling device having a top section comprising a top, having at least one aperture formed therethrough, a push rod projecting downwardly from said top, a sidewall and a base, with the push rod having a rod sidewall and a rod base, and a base section, with the base section detachably secured to the cap section, and with the base section having a bottom and a base section top. The base section top has formed therein a base section aperture and the base section bottom has a pierce pin projecting upwardly therefrom, as well as a lower surface adjacent to the pierce pin. More preferably, the push rod extends beyond the base and the rod base includes a rod indentation. Additionally, a recessed surface is located between the pierce pin and the lower surface. There is also disclosed in combination a capsule containing carbon dioxide and a beverage cooling device having a cap section, which cap section has a top having at least one aperture formed therethrough and a push rod projecting downwardly from the top, and a base section with the base section detachably secured to the cap section. The base section has a bottom and a base section top with the base section top having formed therein a base section aperture and the base section bottom having a pierce pin projecting upwardly therefrom.

It is the primary object of the present invention to provide a beverage cooling device which is conveniently and inexpensively formed and which may be easily utilized in the cooling of the beverage inside of individual beverage containers. It is a further object of the invention to provide a beverage cooling device which is effective at cooling a beverage to a temperature suitable for consumption.

Still another object of the present invention is to provide a beverage cooling device which can be utilized with existing beverage containers.

Other objects and advantages of the invention will be apparent from the following description, the accompanying drawings and the appended claims.

DETAILED DESCRIPTION OF THE INVENTION

Figure 1:
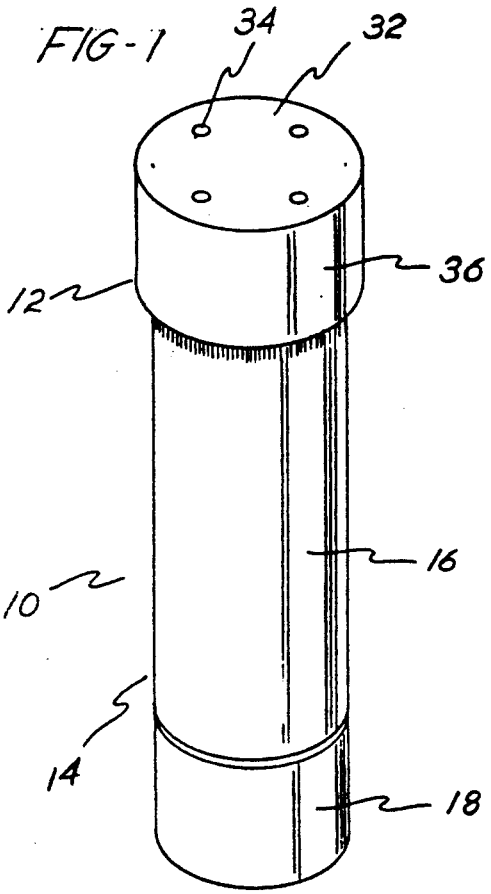
FIG. 1 is a perspective of a beverage cooling device in accordance with the present invention.

FIG. 1 discloses a perspective view of a beverage cooling device made in accordance with this invention with the beverage cooling device being designated generally by the numeral 10. The beverage cooling device 10 comprises a cap section 12 and a base section 14. The base section 14 in the preferred embodiment of the invention is formed from a first component 16 and a second component part 18. Preferably the beverage cooling device is formed of a heat conductive metal such as aluminum or stainless steel, with benefits being seen with respect to stainless steel since the beverage cooling device 10 will be submerged in beverages and thus will require washing.

Figure 2:
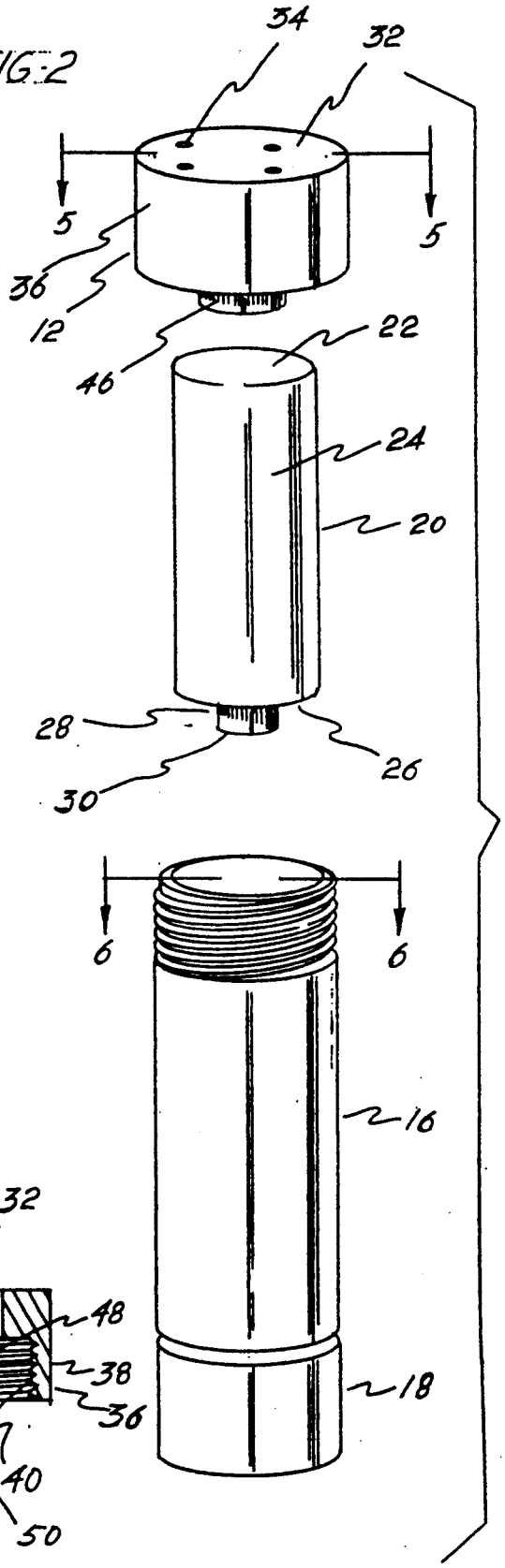
FIG. 2 is an exploded view showing the components which are used to form the beverage cooling device as it is actually used.
Figure 3:
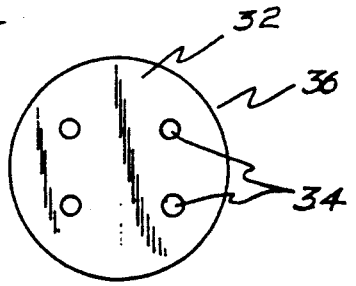
FIG. 3 is a top plan view.
Figure 4:
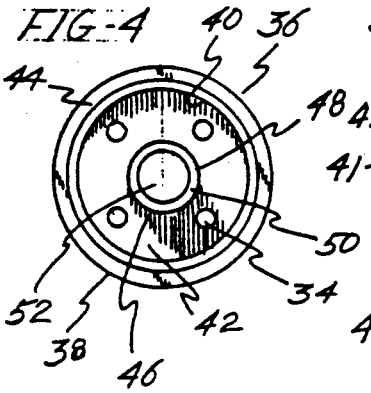
FIG. 4 is a bottom plan view of the cap section of the invention.
Figure 5:
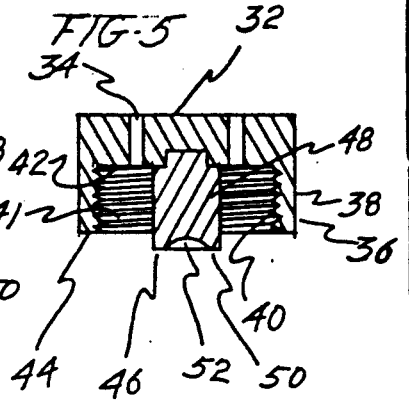
FIG. 5 is a vertical sectional view of the cap section taken along line 5—5 of FIG. 2.

As can be seen in FIG. 2, a capsule of the type currently utilized to store would or pressurized gases such as carbon dioxide for use in propelling model rockets or in the carbonation of homemade soft drinks is shown. The particular capsule 20 typically has a form similar to that shown, but in any event the capsule to be utilized with this invention would have a capsule first end 22, a capsule sidewall 24, and a capsule second end 26 from which there extends a capsule projection 28 which capsule projection comprises a pierceable covering extending across most of, if not all the way across, its end surface.

As can be seen in comparing FIGS. 1-5, the cap section 12 of this invention comprises a top 32 through which a plurality of small apertures 34 are formed. These apertures are formed inwardly of the cap sidewall 36. The cap sidewall 36 is formed having an exterior surface 38 and an interior surface 40, which interior surface 40 preferably includes screw threads which screw threads can be utilized as a means for securably detaching the cap section 12 to the base section 14 of this invention.

The top 32 of the cap section 12 also comprises a lower top surface while the lower ends of the cap sidewall 36 form the cap base 44. Extending downwardly from the top and the lower top surface 42 is a push rod 46 preferably of a cylindrical configuration. This push rod 46 has a rod sidewall 48 and a rod base 50 at the lower edge of the push rod 46. Preferably the rod base 50 includes a rod indentation 52 in the form of a recessed dome for receiving and interfitting with the end of the capsule (20). While the dimensions of the push rod and more particularly the rod base 50 are such that they may make firm contact with the capsule first end 22, the rod indentation 52 is designed to interfit with the capsule 20 in the event that the capsule has a rounded first end.

Figure 6:
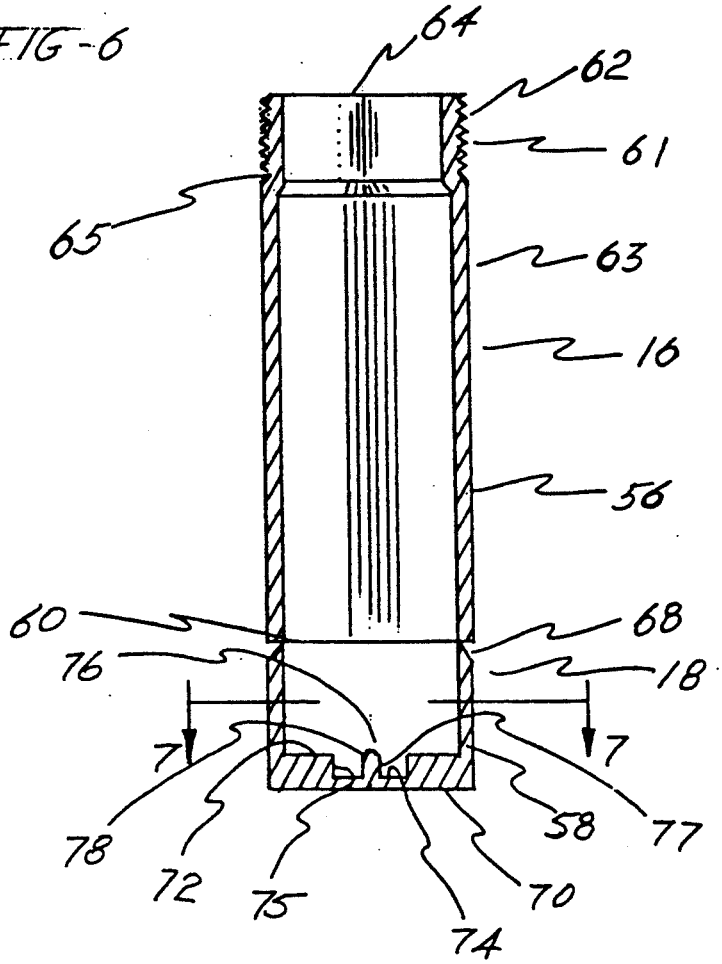
FIG. 6 is a vertical sectional view of the base section of the invention taken along line 6—6 of FIG. 2.
Figure 7:
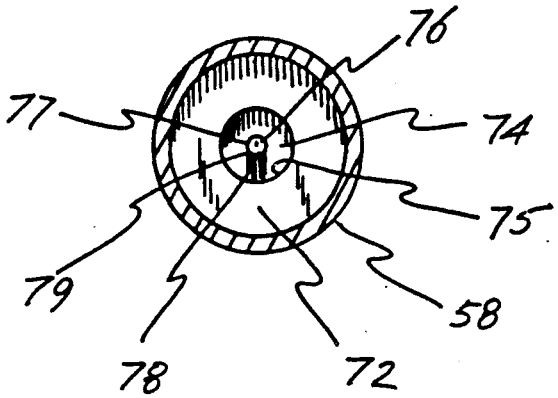
FIG. 7 is a horizontal sectional view taken along line 7—7 of FIG. 6.

Turning now to consideration of FIGS. 6 and 7, as well as comparison of FIG. 6 with FIGS. 1 and 2, it can be appreciated that the base section 14 comprises a first component 16 having first component sidewall 56 while the second component 18 comprises a second component sidewall 58. The first component and second component may be secured to one another by welding or other appropriate means of securing at juncture 60. The first component 16 comprises a top portion 61 having formed on the outer surface thereof screw threads 62 for engagement with the screw threads 41 on the inside wall of the cap section. Additionally, the first component 16 includes a lower portion 63 having formed at its lower edge base aperture 64. Intermediate the top portion 61 and the lower portion 63 is a neck portion 65. Thus, it can be appreciated from the drawings that the inner diameter of the top portion 61 is less than the inner diameter of the lower portion 63 of the first component 16.

With respect to second component 18 it can be seen that in the preferred embodiment of the invention at the uppermost portion of the second component 18 is a beveled top edge 68. The second component also includes a bottom 70, which bottom 70 has an interior lower surface. Located centrally of the interior lower surface is an interior recessed surface 74. While located adjacent and outwardly from the interior lower surface 72 is bottom sidewall 75 of the second component 18. Also located in an upwardly projecting manner from the bottom 70 is a pierce pin 76. It is shown that the pierce pin is located in the center of the bottom 70 and comprises a pin sidewall 77, a beveled top portion 78 and an apex 79. It could be possible that a plurality of pierce pins could be utilized to pierce a pierceable covering of other embodiments of capsules. However, given the structure of the capsule shown in FIG. 2, the preferred embodiment of the invention with respect to pierce pin 76 is shown in FIGS. 6 and 7.

In the actual construction and use of this invention it has been found that the use of compressed gas is desirable. For purposes of this invention compressed gas is understood to include pressurized gases such as liquid carbon dioxide and liquid nitrogen. For example, gaseous carbon dioxide when utilized in connection with this invention produces a temperature lowering affect of approximately 5° F., which temperature lowering affect is inadequate. Furthermore, it was discovered that the use of liquid carbon dioxide in a volume of 1-2 ounces would lower the temperature of a beverage from room temperature to approximately 35° F. less than room temperature which lowering occurs within an acceptable period of time. Other pressurized gases such as liquid nitrogen may be used, depending on the specific amount of gas, the container size and the temperature lowering desired.

The length of the beverage cooling device of this invention should be slightly longer than the height of a conventional beverage can. Thus, the length should preferably be slightly greater than 5". Similarly, the outer diameter of the beverage cooling device 10 made in accordance with this invention should have an outer diameter slightly less than that associated with typical tab openings in beverage cans. It has been found that the outer diameter should therefore be slightly less than ½". With respect to the dimensions of the capsule 20 utilized with the beverage cooling device, it should be obvious that both the outside dimension of the capsule with respect to both length and width should be less than the inner diameter or length of the beverage cooling device.

Additionally, one must take into account the length associated with the push rod, its particular interface with the capsule, and the capsule's particular interface with the bottom of the second component. For example, preferably the pierce pin is oriented so as to pierce the pierceable coating 30 while at the same time permit the capsule projection 28 to be received within the recessed area associated with the interior recess surface 74 between the pierce pin 76 and the interior lower surface 72.

Figure 8:
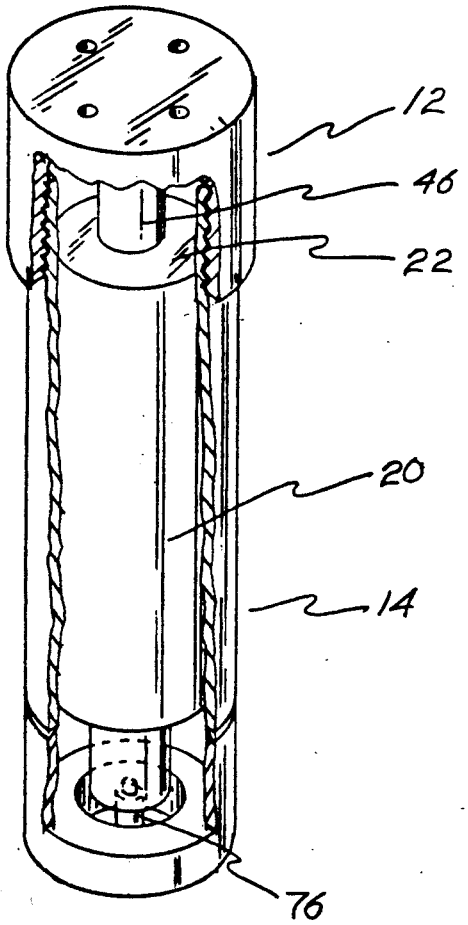
FIG. 8 discloses a perspective view featuring a partially fragmented view, of the invention in use.

In actual use as shown in FIG. 8, a capsule 20 containing liquid carbon dioxide or another liquified gas such as nitrogen is placed into the base section 14 of the beverage cooling device of this invention. The cap section 12 is then placed onto the base section and secured thereto by turning. As the cap is twisted onto the base section, eventually the push rod 46 makes contact with the one end 22 of the capsule such that subsequent turning of the cap section forces the capsule to move in a direction towards the bottom of the base section.

As the cap section continues to be detachably secured to the base section, the pierceable coating of the capsule engages with, and is ultimately pierced by, the pierce pin 76. When this piercing occurs, the compressed gas or liquified gas contained in the capsule is released into the interior of the beverage cooling device. Preferably by this time the beverage cooling device has been inserted into an opened beverage container. As the liquified gas escapes into the beverage cooling container, the liquified gas quickly has its temperature elevated to the point that it changes from a liquid into a gas. As the gas then escapes upwardly through the beverage cooling device and out through the apertures in the top surface thereof, the preferably metallic beverage cooling device is significantly cooled, with this lowered temperature being absorbed by the beverage itself, so as to cool the beverage.

Once the beverage is cooled sufficiently, the beverage cooling device of this invention may be removed from the beverage container. The capsule is removed from the beverage cooling device and the beverage cooling device stored for a subsequent use in the cooling of another beverage.

The beverage cooling device of this invention results in the saving of energy, more efficient storage of beverage containers, and provides for the consumption of cooled beverages in locations or under circumstances not usually associated with the consumption of a cooled beverage, such as during a long distance drive in a warm climate or in outdoor exercises whether they be athletically or militarily related.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. A beverage cooling device comprising a cap section, said cap section comprising a top having at least one aperture formed therethrough, and a push rod projecting downwardly from said top, and a base section, said base section detachably secured to said cap section, said base section having a bottom and a base section top, said base section top having formed therein a base section aperture, said base section bottom having a pierce pin projecting upwardly therefrom, said device adapted to receive a capsule containing liquified gas, said liquified gas being adapted to flow from said capsule, said push rod projects from the center of said cap and has an indentation which interfits with said capsule.

2. The device according to claim 1 wherein said top comprises a plurality of apertures.

3. The device according to claim 1 wherein said cap section comprises a sidewall.

4. The device according to claim 3 wherein said cap section has a base and said push rod extends beyond said base.

5. The device according to claim 1 wherein said cap section and said base section both have screw threads for securing of the two sections together.

6. The device according to claim 1 wherein said push rod comprises a rod sidewall and a rod base.

7. The device according to claim 1 wherein said base section comprises a lower surface adjacent said pierce pin.

8. The device according to claim 1 wherein said base section comprises a first component and a second component, said first component having a top portion, a neck portion and a lower portion, said top portion including means for securing said base section to said cap section, said second component having an upper portion and a lower portion, said second component lower portion comprising said bottom and said pierce pin.

9. A beverage cooling device comprising a cap section, said cap section comprising a top having at least one aperture formed therethrough, a push rod projecting downwardly from said top, a sidewall and a base, said push rod comprising a rod sidewall and a rod base, and a base section, said base section detachably secured to said cap section, said base section having a bottom and a base section top, said base section top having formed therein a base section aperture, said base section bottom having a pierce pin projecting upwardly therefrom and a lower surface adjacent said pierce pin, said device adapted to receive a capsule containing liquified gas, said liquified gas being adapted to flow from said capsule, said push rod projects from the center of said cap and has an indentation which interfits with said capsule.

10. The device according to claim 9 wherein said push rod extends beyond said base.

* * * * *